United States Patent [19]

Zerhoch

[11] 4,177,663

[45] Dec. 11, 1979

[54] PIVOTABLE ROLLER FRAME ASSEMBLY FOR A MATERIAL STRAIGHTENING MACHINE

[75] Inventor: Horst Zerhoch, Sinzheim, Fed. Rep. of Germany

[73] Assignee: Horst Zerhoch-Vorrinchtungs und Machinenbau GmbH & Co. KG, Sinzheim, Fed. Rep. of Germany

[21] Appl. No.: 875,528

[22] Filed: Feb. 6, 1978

[30] Foreign Application Priority Data

Feb. 4, 1977 [DE] Fed. Rep. of Germany ..... 2704674

[51] Int. Cl.[2] ..... B21D 1/02

[52] U.S. Cl. ..... 72/165

[58] Field of Search ..... 72/163-165, 72/160

[56] References Cited

U.S. PATENT DOCUMENTS

| | | | |
|---|---|---|---|
| 1,571,207 | 2/1926 | Lentz | 72/165 |
| 1,876,457 | 9/1932 | Iversen | 72/165 |
| 1,950,655 | 3/1934 | Borton | 72/165 |
| 3,466,913 | 9/1969 | Klempay et al. | 72/163 |
| 3,605,471 | 9/1971 | Bodtke | 72/165 |

FOREIGN PATENT DOCUMENTS 1752211 2/1975 Fed. Rep. of Germany .

*Primary Examiner*—Milton S. Mehr

*Attorney, Agent, or Firm*—Stevens, Davis, Miller & Mosher

[57] ABSTRACT

A roller frame assembly for a material straightening machine is provided with upper and lower roller frames which are pivotable with respect to one another. Each roller frame has a drive transmission separate from that of the other frame for rotating its associated straightening rollers.

3 Claims, 6 Drawing Figures

PIVOTABLE ROLLER FRAME ASSEMBLY FOR A MATERIAL STRAIGHTENING MACHINE

BACKGROUND OF THE INVENTION

This invention relates to a straightening machine for straightening sheets and flat materials which has a lower and an upper roller frame, each having mounting bars spaced a predetermined distance apart for holding positively driven upper or, respectively, lower straightening rollers. The upper and lower straightening rollers are staggered with respect to one another so that the rollers of the upper frame are in alignment with the spaces between the rollers of the lower frame.

Each straightening roller of the upper and lower frame has its own separate drive shaft through which it is driven from a transmission which is fixed, together with the respective roller frame, to a bed plate or the like. Four stay bolts secured by a lock nut and screwed into the lower roller frame are also normally provided to ensure correct alignment of the upper to the lower roller frame, and, in particular, to prevent parallel relative displacement between the rollers of the upper frame and those of the lower frame. Mounted on each of these stay bolts is a compression spring so that the upper roller frame is cushioned on the lower frame. The upper frame can be moved towards or away from the lower frame, for example, by turning a nut acting on the stay bolt.

In these known straightening machines, the upper roller frame can only be raised very slightly away from the lower frame, particularly because of the arrangement of the driving mechanism. As a result, the straightening rollers are relatively inaccessible and cleaning of the straightening apparatus is very difficult and time consuming. The arrangement of the driving mechanism prevents the upper roller frame from being tilted upwards because this would cause the individual drive shafts of the straightening rollers to be twisted over one another. Moreover, the compression springs on the stay bolts would have to be placed back into position after each frame opening because they would fall off whenever the frame was opened.

Accordingly, an object of the present invention is the provision of a straightening machine roller assembly in which the straightening rollers of an upper and lower roller frame, which cooperate with each other during the straightening process, can easily be moved far enough apart to allow for much easier cleaning of the machine and/or simple replacement of individual parts, for example, individual straightening rollers. More particularly, a straightening machine constructed according to the teachings of the present invention is distinguished from known roller straightners by the fact that the upper roller frame can be tilted about an axis by a large angle away from the lower roller frame, for example, an angle greater than 90°.

According to one advantageous embodiment of the invention, two separate transmissions, one associated with the upper roller frame and one associated with the lower roller frame, are employed. The transmissions are drivingly connected by a connecting shaft having an axis which lies in the pivotal axis between the lower and the upper roller frame. This connecting shaft is preferably a universal joint shaft so that the upper roller frame can be slightly shifted away from the lower frame to adapt the space between them to the thickness of the material, the straightening pressure, etc. without the need for separate drives for the upper and the lower roller frame.

To prevent the compression springs, which provide the flexible pressure of the upper roller frame against the lower frame, from falling off the straightening machine as mentioned above, they are not mounted on the stay bolts, but rather are moved slightly away from them and constructed, for example, as separate spring bolts.

The above objects and construction details of the invention are more fully described below with particular reference being had to the drawings, which illustrate by way of example one embodiment of the present invention.

DETAILED DESCRIPTION OF THE INVENTION

Figure 1:
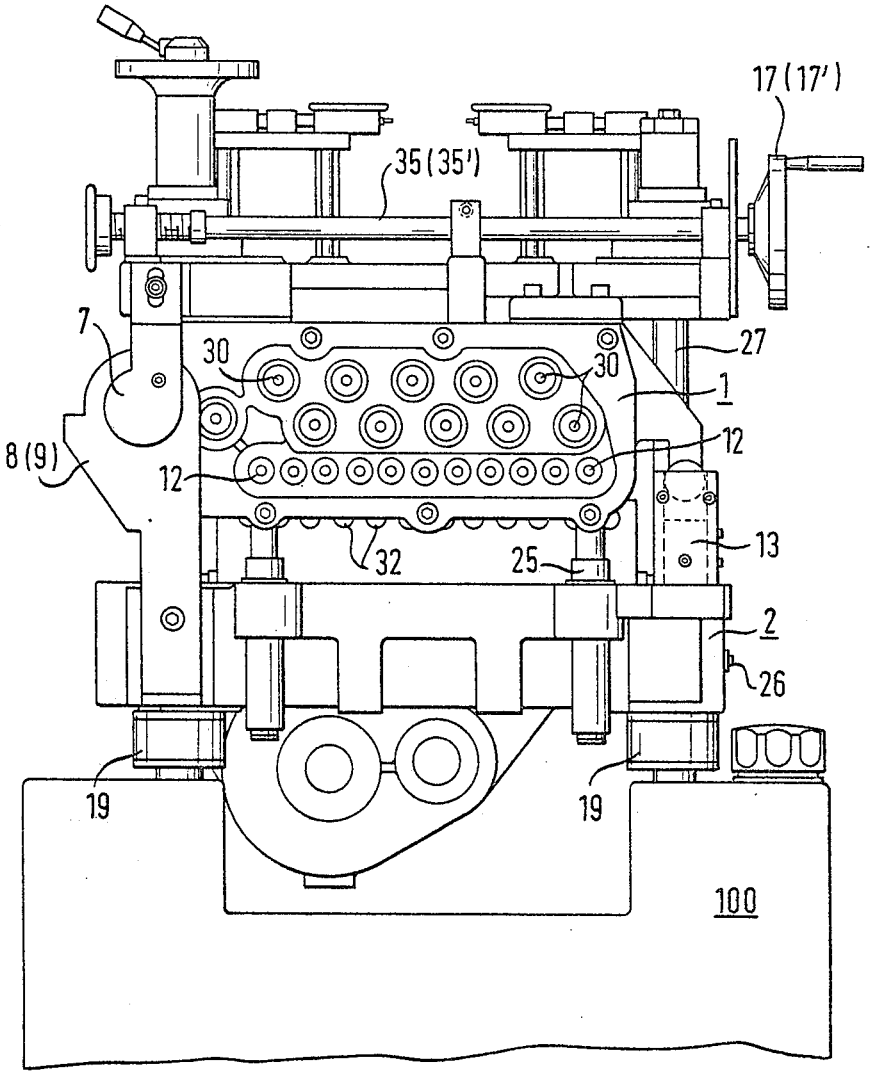
FIG. 1 shows, in side view, a roller straightener constructed in accordance with the teachings of the present invention.

The structure of the roller straightener will first be described with reference to FIGS. 1 and 2:

A machine frame (not indicated in detail) is fixed to a bench 100, bed plate, or the like. This machine frame has a fixed lower roller frame 2 and serves as support for an upper roller frame 1 which is pivoted to it through a pivot bearing 8, 9 arranged on the left or right. The upper frame 1 is kept in the correct operating position by a supporting guide 16, 16' which is automatically adjusted by a guide block 13, 13' fixed in the lower roller frame 2. Fixed into the upper roller frame is a pair of mounting bars **11*a*, 11*b* which are placed sufficiently far apart to leave a gap between them equal to the maximum width of the material which is to be straightened. As can be seen clearly in FIG. 2, the two parallel bars 11*a*, 11*b* rotatably mount and support a first set of straightening rollers 12 which are placed at equal distances apart. In order to counteract any tendency of the rollers 12 to bend upwards when subjected to severe pressure from the material which is to be straightened, back-up rollers 31 are provided, which are mounted to be freely rotatable, for example, in four pairs of mounting bars 29. As shown in FIG. 2, the six back-up rollers situated in the first row from the left are coaxial with the back-up rollers in the third row from the left, while the axes of the back-up rollers of the second and fourth rows from the left are in alignment with each other and staggered with those of the back-up rollers of the first and third rows from the left. The upper roller frame contains, for example, six back-up rollers in each of the first and third rows of back-up rollers from the left (see FIG. 2) and five back-up rollers 31 in the second and fourth rows from the left. The axial position of the back-up rollers is indicated in FIG. 1 by the reference numeral 30**.

Analogously to the construction of the upper roller frame 1, mounting bars 28*a* and 28*b* placed at a suitable distance apart are provided in the lower roller frame 2 for rotatably mounting and supporting a lower group of parallel straightening rollers 32 spaced equal distances apart transversely to the direction of transport of the material. Four pairs of mounting bars 33 (see FIG. 2) analogous to the four pairs of bars 29 for back-up rollers 31 are provided in the lower roller frame for supporting freely rotatable back-up rollers 14. These back-up rollers 14 in the lower frame similarly prevent sagging of the back-up rollers 32 under pressure exerted transversely to the axis of the rollers during the straightening process.

As illustrated in FIG. 1, when the upper roller frame is closed the axes of all of the upper straightening rollers 12 lie in a plane parallel to the plane of the axes of all of the straightening rollers 32 of the lower roller frame 2. The gap between the two groups of rollers 12 and 32 is adjusted in known manner by spindles 37, 37′ operated by hand wheels 17, 17′. It is possible to provide for a slight difference in the straightening gap between the inlet end for the material and the outlet end by using a different pitch and/or different adjustment of the supporting nuts (not shown) for the spindles 35, 35′ on the two sides of the machine, i.e., the right and left hand side in FIG. 1. Suitable compensation for the inclination on the pivot bearing 8, 9 can be achieved by providing a supplementary pivot bearing 7.

To reduce noise and vibration, the whole assembly comprising the upper and lower roller frames 1 and 2 is supported on the machine bed 100 by strong rubber springs 19.

The number of straightening rollers is obviously not restricted to the number illustrated, i.e., 11 rollers 12 in the upper frame and 12 rollers 32 in the lower frame. Any number of rollers could, in principle, be employed although the number in one group of rollers (e.g., rollers 32) should always be one greater than the number of rollers in the other group (e.g., rollers 12). The same applies to the number of mounting bars 29 and 33 for the back-up rollers and the number of back-up rollers 31 and 14 in the upper and lower roller frame.

Figure 2:
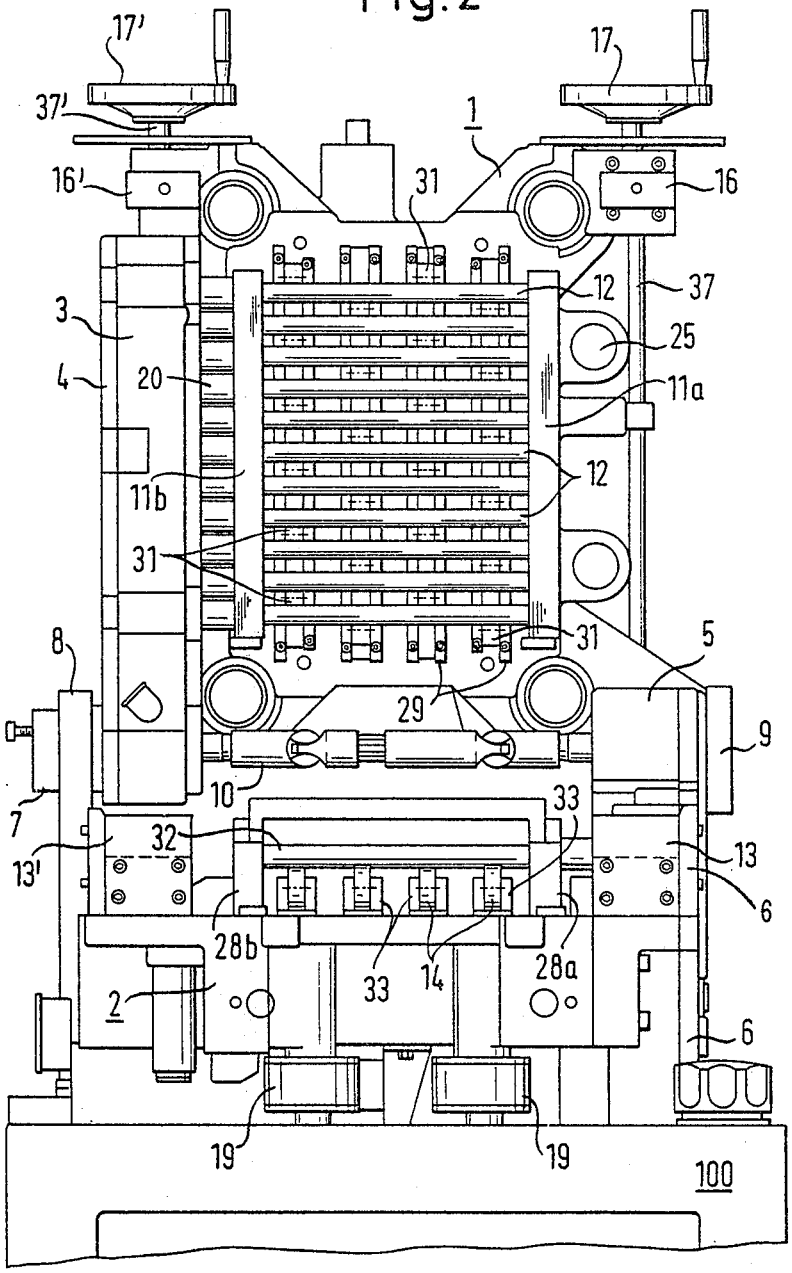
FIG. 2 shows a front view of the roller straightener of FIG. 1 with the upper roller frame tilted up.
Figure 4:
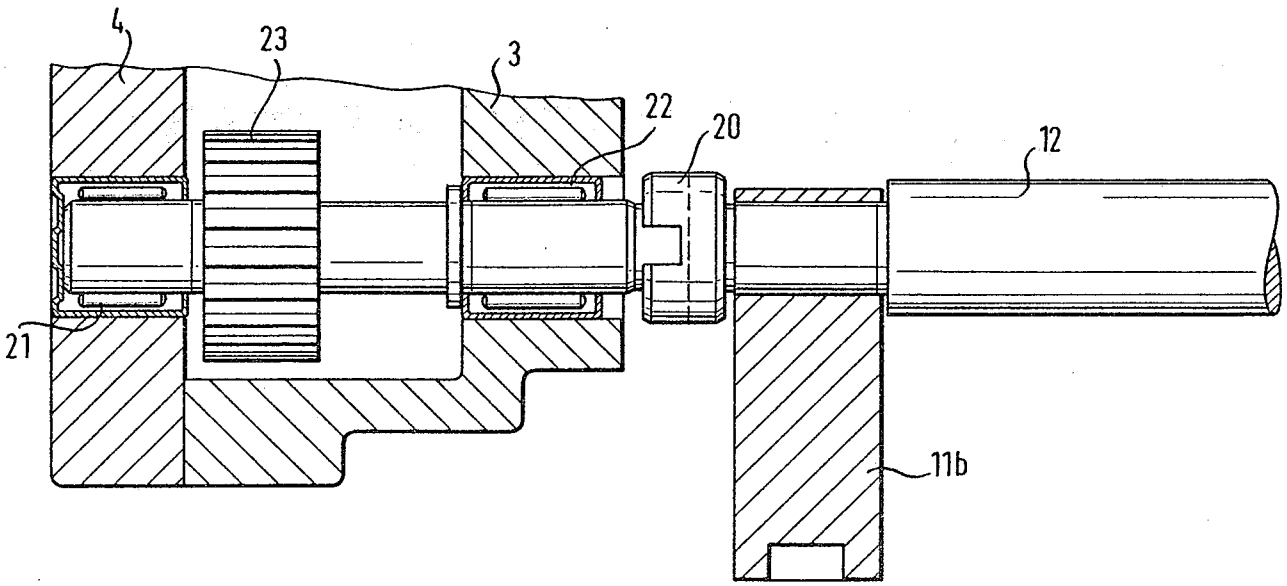
FIG. 4 shows the driving means for an individual straightening roller.

The straightening rollers 12 of the upper roller frame 1 are driven from the left, as viewed in FIG. 2, by an upper transmission via couplings 20 which are adapted to yield in a direction parallel to the roller axis. These so-called Oldham couplings are best illustrated in FIG. 4. For the sake of simplicity of the drawing, only the upper gear box 3 has been shown in FIG. 2 since the transmission mechanism itself is not a subject of the present invention. The upper gear box 3 is closed by a gear cover 4. The partly sectional view of FIG. 4 shows the driving mechanism for one of the straightening rollers 12. A pinion 23 mounted at one end of a needle case 21 in the gear cover 4 and at the other end in a needle bushing 22 in the opposite wall of the gear box 3 is connected by way of the Oldham coupling 20 to the straightening roller 12 which is mounted in the mounting bars 11*a*, 11*b*.

The group of lower straightening rollers 32 is similarly driven by a transmission from the opposite side, i.e., from the right as viewed in FIG. 2, by way of Oldham couplings. Here again, only the lower gear box 5 with gear cover 6 has been shown in order to avoid complicating the drawings. The group of upper rollers 12 is thus driven by its own transmission which is associated with the upper roller frame 1 and arranged on the left hand side of FIG. 2 while the group of lower rollers 32 is also driven by way of a separate transmission which is associated with the lower roller frame 2. This aspect of the invention differs from the prior art since in known roller straighteners all the rollers are driven from a single transmission by way of individual drive shafts.

The transmission for the upper roller frame 1 (hereinafter referred to as upper transmission) and the transmission for the lower roller frame 2 (hereinafter referred to as lower transmission) are connected through a drive shaft 10 (FIG. 2) having an axis in substantial alignment with the pivotal axis of the upper roller frame 1. This driving connection between the lower transmission on the right hand side and the upper transmission on the left hand side through a drive shaft 10 provides for the adjustable positioning of the upper roller frame in relation to the lower frame. The drive for all the rollers is preferably first transmitted by way of the lower transmission to the lower group of levelling rollers 32 and from there through the drive shaft 10 and upper transmission to the upper rollers 12.

Figure 5:
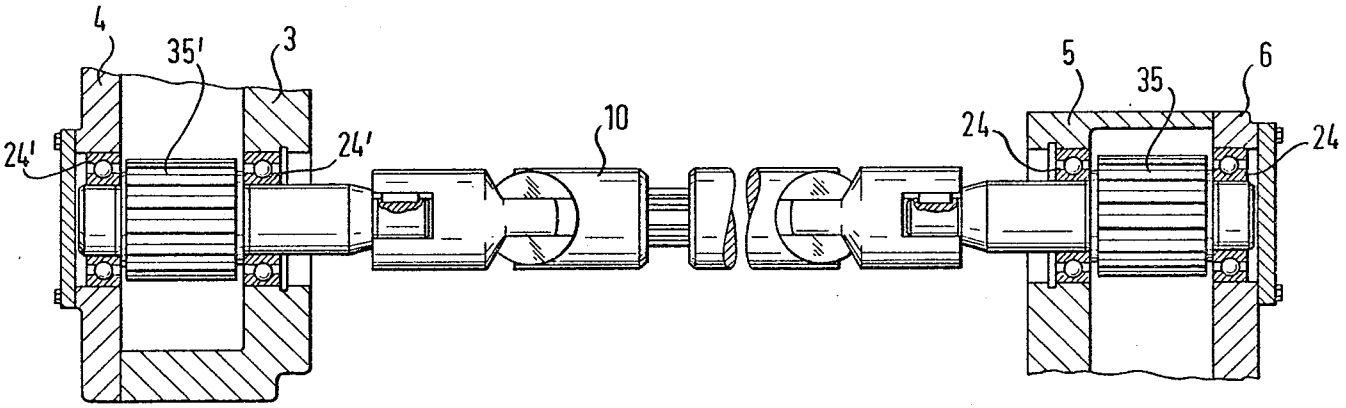
FIG. 5 shows a drive shaft through which the straightening rollers of the upper and lower frame are drivingly connected.

FIG. 5 illustrates an example of the drive shaft 10 and its mounting means. The drive is transmitted from the transmission associated with the lower roller frame 2 to the transmission associated with the upper roller frame through a pinion 35 mounted by ball bearings 24 in the lower gear box 5 and lower gear cover 6 and through a pinion 35′ mounted in ball bearings 24′ in the upper gear box 3 and upper gear cover 4.

Figure 3A:
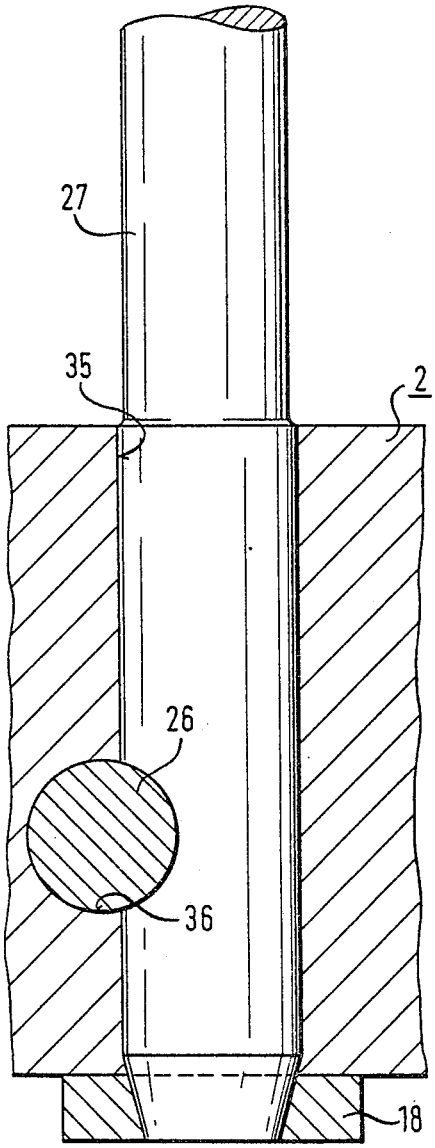
FIGS. 3A and 3B show the manner in which a stay bolt is fixed in the roller straightener of FIGS. 1 and 2.
Figure 3B:
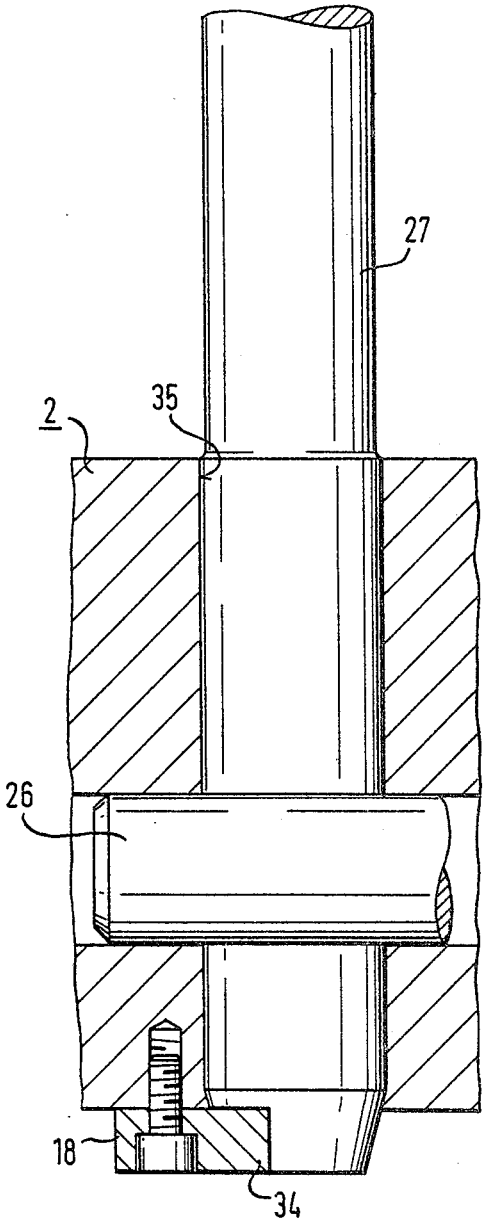

Four stay bolts 27 (FIG. 3) are firmly fixed in the upper roller frame 1. When the upper roller frame 1 is pivoted into the operative position, these stay bolts 27 are inserted into corresponding bores 35 in the framework of the lower roller frame 2, thereby ensuring that the straightening rollers 12 of the upper roller frame will be correctly positioned in relation to the lower straightening rollers 32. As can be seen in FIG. 3, the bottom end face of the stay bolts 27 has a step (see FIG. 3B) which abuts against a stop 34 screwed into the base of the lower roller frame 2, thereby limiting the excursion of the stay bolts 27 in the axial direction. The stay bolts 27 are further secured in the vertical direction in the operative position of the roller straightener by means of axially displaceable transverse locking bolts 26 which can only be pushed into position through a notch 36 in the lower part of the bolts 27 when the stay bolts 27 are in their correct position.

The invention is a complete solution to the problem it sets out to solve. A roller straightener according to the invention affords the special advantage that the upper roller frame can be tilted up so that the straightening rollers, back-up rollers and other parts of both roller frames are readily accessible, thereby simplifying servicing and cleaning. Constructional simplifications are also achieved since the use of separate transmissions dispenses with the need for separate drives with drive shafts for each individual straightening roller. The overall machine construction is considerably simpler than prior art machines and has smaller overall dimensions.

What is claimed is:

1. A straightening machine for straightening flat and sheet materials flowing therethrough comprising:

an upper and a lower roller frame each having a pair of spaced mounting bars supporting a plurality of positively driven straightening rollers arranged traversely to the direction of material flow, the straightening rollers of said upper frame being staggered in relation to the straightening rollers of said lower frame;

means for pivotably coupling said upper roller frame to said lower roller frame, said means allowing said upper roller frame to pivot with respect to said lower roller frame about an axis which is parallel to the axes of said straightening rollers;

a first drive transmission attached to said upper roller frame for driving said straightening rollers of said upper frame;

a second drive transmission attached to said lower roller frame for driving said straightening rollers of said lower frame; and, a universal joint connecting shaft having an axis in said pivotal axis drivingly connecting said first and second drive transmissions.

2. A straightening machine as in claim 1, wherein said first and second transmissions are connected to their respective straightening rollers through respective couplings associated with each roller which are adapted to yield in a direction parallel to the axes of said rollers.

3. A straightening machine as in claim 2 further comprising a plurality of guide bores provided in said lower roller frame, a plurality of stay bolts fixed to said upper frame and associated with said said guide bores, said stay bolts being adapted for insertion in respective guide bores when said upper and lower frames are disposed facing each other, and a plurality of locking bolts associated with said guide bores, said locking bolts being displaceable to secure said stay bolts in position in said guide bores.

* * * * *